US007766610B2

(12) United States Patent
Busekros et al.

(10) Patent No.: US 7,766,610 B2
(45) Date of Patent: Aug. 3, 2010

(54) TURBOMACHINE

(75) Inventors: Armin Busekros, Zurich (CH); Darran Norman, Horsham (GB); Matthias Rothbrust, Dietikon (CH)

(73) Assignee: Alstom Technology Ltd, Baden (CH)

( * ) Notice: Subject to any disclaimer, the term of this patent is extended or adjusted under 35 U.S.C. 154(b) by 968 days.

(21) Appl. No.: 11/245,062

(22) Filed: Oct. 7, 2005

(65) Prior Publication Data

US 2006/0073010 A1 Apr. 6, 2006

Related U.S. Application Data

(63) Continuation of application No. PCT/EP2004/050442, filed on Apr. 5, 2004.

(30) Foreign Application Priority Data

Apr. 7, 2003 (CH) ..... 0628/03

(51) Int. Cl.
*F01D 25/12* (2006.01)

(52) U.S. Cl. ..... 415/144; 415/108; 415/116

(58) Field of Classification Search ..... 415/1, 415/108, 115, 116, 144
See application file for complete search history.

(56) References Cited

U.S. PATENT DOCUMENTS

| | | | | |
|---|---|---|---|---|
| 2,402,841 | A * | 6/1946 | Ray | 415/47 |
| 2,650,794 | A | 9/1953 | Roder | |
| 3,793,905 | A | 2/1974 | Black et al. | |
| 4,854,120 | A | 8/1989 | Nelson et al. | |
| 5,388,960 | A * | 2/1995 | Suzuki et al. | 415/176 |
| 5,980,201 | A * | 11/1999 | Benoist et al. | 415/115 |
| 6,478,534 | B2 * | 11/2002 | Bangert et al. | 415/1 |
| 6,523,346 | B1 | 2/2003 | Hoffmann et al. | |
| 7,273,345 | B2 * | 9/2007 | Birrell et al. | 415/1 |
| 2001/0022933 | A1 | 9/2001 | Bangert et al. | |

FOREIGN PATENT DOCUMENTS

| | | |
|---|---|---|
| DE | 507 129 | 9/1930 |
| DE | 675 253 | 5/1939 |
| EP | 0 620 362 A1 | 10/1994 |
| WO | 00/11324 A1 | 3/2000 |

OTHER PUBLICATIONS

PCT.ISA/210 dated Jul. 28, 2004.
PCT/ISA/237 dated Apr. 7, 2003.

* cited by examiner

*Primary Examiner*—Edward Look
*Assistant Examiner*—Dwayne J White
(74) *Attorney, Agent, or Firm*—Buchanan Ingersoll & Rooney PC

(57) ABSTRACT

Annular or ring-segment-shaped cavities (2, 7) which are formed in particular in multi-shell (11; 12, 13) casings of turbomachines are preferably provided with suitable means for compensating for forming temperature stratifications. According to the invention, an overflow passage (14) connects two points of the cavity to one another which are situated in different circumferential positions. Arranged in the overflow passage (14) is an ejector (17) which can be operated with a motive fluid and which serves to drive a flow through the overflow passage from an upstream end (15) to a downstream end (16).

13 Claims, 4 Drawing Sheets

TURBOMACHINE

TECHNICAL FIELD

The present invention relates to a turbomachine according to the preamble of claim 1. It also relates to a method of operating such a turbomachine.

PRIOR ART

The phenomenon of the "bowing" of the rotor and also of the casing of turbomachines such as gas turbines and steam turbines is sufficiently known. It is caused by the large and high-mass structures of such machines having stored considerable quantities of heat after prolonged operation. During the cooling, a pronounced vertical temperature stratification occurs in the comparatively large flow passages, and this temperature stratification leads to uneven temperature distributions in the static and the rotating components, which results in distortion of casing and rotor and deviations from the rotationally symmetrical desired geometry on account of the different thermal expansions. With the unavoidably small gap dimensions in modern turbomachines, jamming of the rotor in the casing occurs as a result, which adversely affects the starting availability and in addition is able to put the mechanical integrity at risk. Systems for shaft turning or also for "shaft indexing" have therefore been disclosed, for example, by U.S. Pat. No. 3,793,905 or U.S. Pat. No. 4,854,120. In this case, the rotor of a turbomachine is turned further at a certain speed after the shutdown. Here, as in the known shaft indexing, low speeds within the region of 1 rev/min or less are preferred. On the one hand, this is sufficient in order to make the cooling of the rotor more uniform in the circumferential direction; on the other hand, the speed is low enough in order not to cause any pronounced axial flow, for instance, through the hot-gas path of a gas turbine, with associated input of cold air and thermoshock.

In the part subjected to high thermal loading, modern gas turbines are often designed with twin-shell casings. In this case, an annular space, to which cooling air or other coolant is often admitted during operation, is formed between an inner casing and an outer casing. Without further measures, a vertical temperature stratification likewise forms in the annular space after the gas turbine has been shut down, and this temperature stratification leads to distortion of the casings.

DE 507 129 and also WO 00/11324 propose to provide means in a two-shell casing of a turbine in order to disturb the stable temperature stratification by a forced flow inside the intermediate space. In this case, it is essentially proposed to deliver, outside the annular space, fluid from one point of the annular space to another point of the annular space, as a result of which a compensating flow is induced inside the annular space. The publications in this case specify the arrangement of an overflow passage preferably outside the machine casing, this overflow passage connecting two points of the casing to one another which are situated in different circumferential positions, and the arrangement of a circulation blower for driving the compensating flow inside this overflow passage. The drive of the circulation blower tends to be a problem in practice. A drive shaft of the blower, this drive shaft leading from a motor arranged outside the overflow passage to the blower impeller arranged inside, must be reliably sealed off under operating conditions. On account of the prevailing high pressures, which in modern gas turbines may easily reach values around 30 bar and above, and which may be even higher in steam turbines, and the temperatures, which may already reach up to 500° C. even in the cooling air, the object can only be achieved with considerable outlay, and there is a latent risk of failure over a long operating period.

SUMMARY OF THE INVENTION

The object of the invention is to specify a turbomachine of the type mentioned at the beginning which avoids the disadvantages of the prior art.

According to the invention, this is achieved by all the features of claim 1 in their entirety.

The essence of the invention is therefore to arrange an ejector inside the overflow passage, through which ejector, if the need arises, a motive-fluid flow can be directed for driving the flow through the overflow passage. It is therefore not necessary to seal off a leadthrough of a movable component through the wall of the overflow passage. Since, on the one hand, the mass flow of the motive fluid which is directed through the ejector is markedly smaller than the design mass flow of the overflow passage, and, on the other hand, the flow velocity through the ejector is still to be high anyway, flow cross sections which are substantially smaller than for the overflow passage are advantageously used for the feed line to the ejector. Typically, the design mass flow of the ejector is around 8% to 15%, in particular 10%, of the design mass flow of the overflow passage. The ejector inflow line can thus be isolated from the volume of the cavity in a substantially simpler manner by a nonreturn and/or a shutoff element. Furthermore, since the ejector flow serves of course essentially as motive fluid, and an external auxiliary medium can be used, there is considerable latitude in the selection of the suitable drive source. Thus, the ejector flow need not necessarily be driven by a blower, but rather, for example, air from a compressed-air system or steam from a boiler can easily be used. Since the system is operated when the plant is at rest, after the turbomachine has been shut down, ambient pressure essentially prevails in the cavity during operation of the ejector. It is thus not even necessary to impose stringent requirements on the supply pressure of the motive fluid used for the flow through the ejector. In the case of air as motive fluid of the ejector and atmospheric pressure in the cavity, critical states are already achieved in the ejector anyway at a supply pressure of the motive fluid of around 1.7 bar. In a preferred embodiment of the invention, the motive-fluid source for the ejector is selected in such a way that the supply pressure of the motive fluid is 1.3 to 3 times, preferably 1.5 to 2 times, the pressure in the cavity. Furthermore, it is preferred if the volume of the cavity is circulated by the flow in the overflow line around 4 to 8 times, preferably about 6 times, per minute. In an especially preferred embodiment of the invention, the volume of the cavity is circulated once in around 11 seconds. It has been found that this circulation rate leads to especially good homogenization of the temperature distribution in the cavity.

The apparatus according to the invention is preferably operated in such a way that, when the turbomachine is at rest, in particular during a cooling phase of the turbomachine following the shutdown, a fluid is directed as motive fluid into the overflow passage through the ejector and drives a flow there, by means of which the gas contents of the cavity are circulated. A fluid mass flow is thus fed to the cavity through the ejector, this fluid mass flow, per second, in preferred embodiments of the invention, being within the range of 0.5% to 2% and in particular preferably around 1% of the contents of the cavity, in such a way that the contents of the cavity are exchanged once within the range of 50 to 200 seconds. Thus, in contrast to the prior art, there is no completely closed system. The motive fluid used may be, in particular, ambient air or air from an auxiliary-air system, for example instrument air. This may be readily utilized in an advantageous manner in order to help to make the temperature distribution more uniform and in order to shorten the cooling phase. If fluid is bled at a point of the casing cavity situated at the bottom and is mixed with cold ambient air by the ejector inflow, and if this mixed overflow is introduced again in the top part of the cavity, this contributes to additional, perfectly desirable cooling in the casing segments situated at the top. This additional cooling effect on the basis of the motive-fluid flow fed from outside brings about additional cooling, to be precise, in an appropriate design, exactly where it is desired, namely in the top part, which tends to be rather on the hot side. In another embodiment of the invention, the motive fluid of the ejector is preheated; in the process, it may be directed, for example, over or through further heated components of the turbomachine. For compensation, medium must of course also flow off from the cavity; this is preferably effected through the coolant path of the turbomachine.

The cavity is in particular formed between an inner and an outer casing of the turbomachine, thus, for example, between a combustor wall and an outer casing of a gas turbine. In this case, the cavity is designed with an essentially annular cross section, in particular as a torus, or with a cross section in the shape of a ring segment. The overflow passage is advantageously arranged outside the casing of the turbomachine. This ensures excellent accessibility and facilitates the retrofitting capacity of existing installations. The overflow passage advantageously connects two points of the cavity to one another which are arranged essentially in diagonally opposite circumferential positions. The orifices of the overflow passage are advantageously likewise arranged at different geodetic heights of the cavity, the downstream end of the overflow passage, to which the ejector drives the flow, being advantageously arranged at the higher point. This arrangement utilizes the density differences of the fluid inside the cavity. In an especially preferred embodiment of the invention, the orifices of the overflow passage are arranged at the cavity in a circumferential position situated geodetically at the highest point and in a circumferential position arranged geodetically furthest at the bottom, the flow in the overflow line being directed from bottom to top, as it were from the "floor" of the cavity to its "ceiling". Thus, during operation of the apparatus, comparatively cool fluid is delivered from the bottom part of the cavity into the overflow passage and is mixed there with the motive fluid of the ejector, the motive fluid generally being even cooler. At the point of the outflow into the cavity, in its top part, the fluid is warmer and therefore has a lower density. The cooler fluid introduced consequently sinks and thus induces a compensating flow in the cavity. This compensating flow is even self-regulating to a certain extent: the greater the temperature difference between the top part and the bottom part of the cavity of the turbomachine casing, the greater is the density difference which drives the flow. That is to say that, the more uneven the temperature distribution in the cavity, the greater become the drive forces which induce a compensating flow for making the temperature more uniform.

In a further preferred embodiment of the invention, the overflow line opens out in the cavity with a defined outflow section. The outflow section is in particular made in such a way that the outflowing medium is oriented with at least one velocity component in the circumferential direction of the cavity. This has the advantage that the flow is defined in the cavity. The outflow section, which acts as discharge guide device, advantageously opens out essentially in the circumferential direction or in such a way that the outflow direction is inclined in the axial direction by an angle of less than 30°, preferably less than 10°, relative to the circumference of the cavity. In an especially preferred embodiment, the outflow section is designed as a nozzle such that it acts as an ejector and likewise drives the fluid inside the cavity. In particular in combination with an axially set defined outflow direction and in the case of an axially extended cavity, the orifices of the overflow passage, in a preferred embodiment of the invention, are in different axial positions. The resulting helical flow through the cavity then makes the temperature distribution more uniform in the axial and circumferential directions.

In a configuration of the invention, the cavity has openings for drawing off fluid, through which openings fluid can flow off from the cavity. This is advantageous in particular when fluid is fed from outside. The openings are preferably arranged symmetrically on the circumference, for example in the form of an annular gap, ring-segment-shaped gaps, or holes distributed on the circumference. The openings are fluidically connected, for example, to the hot-gas path of a gas turbine, so that fluid which is located in the cavity and which is displaced by freshly fed fluid can flow off into the hot-gas path. In this connection, the expression "hot-gas path" refers to the entire flow path from the inlet into the first turbine guide row right up to the exhaust-gas diffuser. In particular, the fluid can be drawn off via the cooling-air path and the cooling openings, for example of the first turbine guide row, into the hot-gas path.

BRIEF DESCRIPTION OF THE DRAWINGS

The invention is to be explained in more detail below with reference to the drawing, in which, in detail.

Of course, the following figures only represent illustrative examples and are unable to represent anything like all the embodiments of the invention, as is characterized in the claims, which are revealed to the person skilled in the art.

WAY OF IMPLEMENTING THE INVENTION

Figure 1:
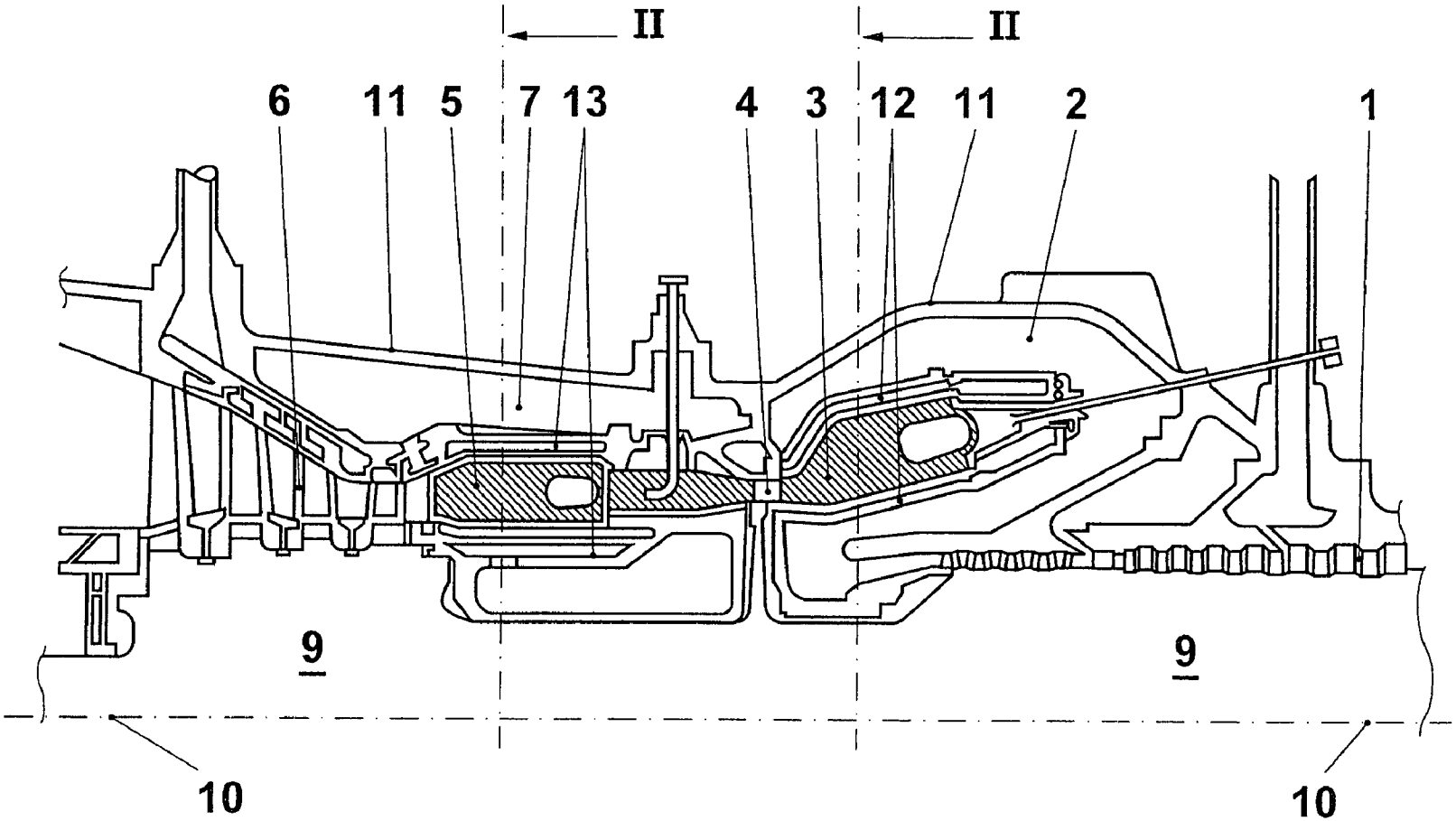
FIG. 1 shows part of a thermal block of a gas turbine.

The invention is to be explained in the context of a turbomachine. The thermal block of a gas turbine is therefore shown in FIG. 1, only the part located above the machine axis 10 being shown. The machine shown in FIG. 1 is a gas turbine having "sequential combustion", as disclosed, for example, by EP 620362. Although its functioning is not of primary importance for the invention, it may be explained in broad outline for the sake of completeness. A compressor 1 draws in an air mass flow and compresses it to a working pressure. The compressed air flows through a plenum 2 into a first combustor 3. A fuel quantity is introduced there and burned in the air. The hot gas produced is partly expanded in a first turbine 4 and flows into a second combustor 5, what is referred to as an SEV combustor. Fuel supplied there ignites on account of the still high temperature of the partly expanded hot gas. The reheated hot gas is expanded further in a second turbine 6, mechanical output being transmitted to the shaft 9. During operation, temperatures of several 100° C. already prevail in the last compressor stages, and even more so in the region of the combustors 3, 5 and in the turbines 4, 6. After such a machine has been shut down, the large masses—for example a mass of the rotor 9 of 80 tonnes—store a large quantity of heat for a prolonged period of time. In the flow cross sections of the machine, at least in the conventional set-up of a gas turbine having a horizontal machine axis, a pronounced vertical temperature stratification occurs during the cooling when the machine is at rest. This temperature stratification leads to the bottom and top parts of the casing and rotor cooling at different rates, as a result of which distortion of the components occurs, which is referred to as "bowing".

Figure 2:
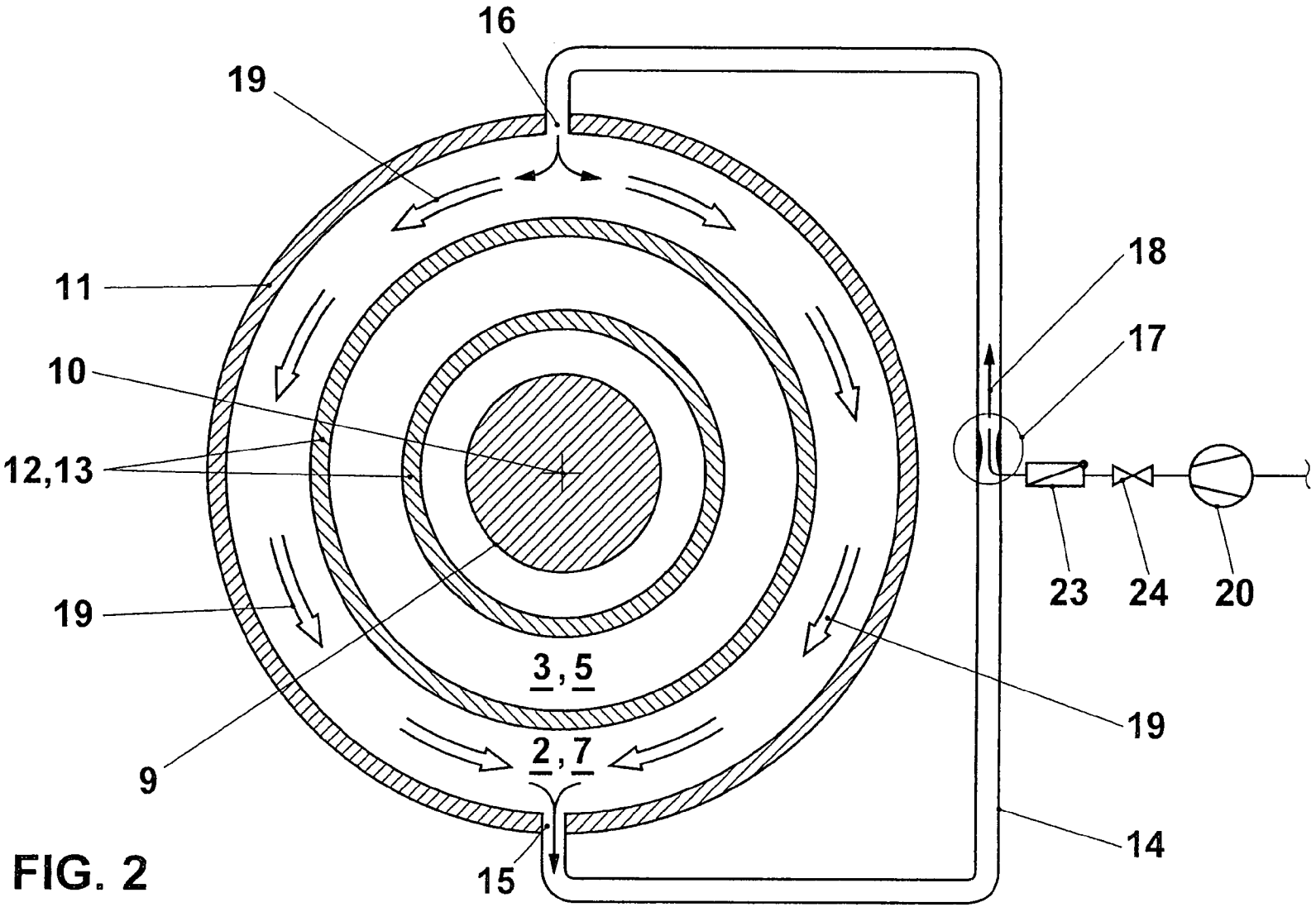
FIG. 2 shows a first example for the embodiment according to the invention of the gas turbine from FIG. 1 in cross section.

In the gas turbine shown as an example, the invention is realized in each case in the region of the cavities 2, 7 surrounding the combustors 3, 5. The cross-sectional illustration in FIG. 2 is highly schematic and could represent a section both in the region of the first combustor 3 and in the region of the second combustor 5. A respective annular cavity 2, 7 is formed between an outer casing 11 of the gas turbine and a combustor wall 12, 13, which may also be referred to as inner casing. After the machine has been shut down, a considerable proportion of the heat which is stored in the structures 9, 12, 13 is dissipated via the outer casing 11. In the process, fluid in the cavities 2, 7, on account of density differences, tends to build up the stable temperature stratification mentioned, the avoidance of which is of course the object of the invention. In the example shown for the embodiment of the invention, the outer casing is provided with a bleed point 15, which is connected to a first, upstream end of an overflow line 14. The second, downstream end 16 of the overflow line opens out again in the cavity at a point essentially diagonally opposite the bleed point 15. To drive a flow through the overflow line, a jet pump arrangement 17 having an ejector is arranged in the overflow line. From any desired source per se for a medium under pressure, a motive-fluid mass flow 18 is directed to the ejector and flows there at a comparatively high velocity, as a result of which further fluid located in the overflow line is entrained and a flow through the overflow line is thus induced. Due to the embodiment like a jet pump, the mass flow of the entrained fluid is a multiple of the motive-fluid mass flow; typically, the driven mass flow in a preferred embodiment of the invention is around 10 times the motive-fluid mass flow. The orientation of the flow from an upstream end 15 to a downstream end 16 is predetermined by the orientation of the ejector. In the exemplary embodiment, the orifice of the upstream end is arranged at a point situated geodetically at the lowest location, and the orifice of the upstream end 16 is arranged at a point situated geodetically at the highest location. The coolest fluid located in the cavity is thus sucked into the overflow line 14. This fluid is mixed with the motive-fluid mass flow 18, which is often even colder; for example, this may involve ambient air fed via a delivery blower or a compressor 20. However, the fluid discharging at the downstream end of the overflow line thus has a greater density than the fluid at the point situated geodetically at the top in the cavity. Consequently, a sinking movement in the cavity occurs, and this sinking movement further intensifies a compensating flow 19. This intensifying is all the greater, the greater the density differences in the cavity are, that is to say the more pronounced the temperature stratification is. The system is thus self-regulating in one way, and the compensating flow 19 is all the more intensive, the more pronounced the temperature stratification is. The fluid is preferably recirculated once in the cavity in around 8 to 15 seconds. The motive-fluid mass flow specified above results in the fluid contents in the cavity being exchanged once every 80 to 150 seconds for fresh fluid flowing in via the ejector 17. This may possibly result in undesirable rapid cooling of the machine structures. It is then of course also possible to preheat the motive fluid of the ejector in order to reduce this cooling. During operation of the gas turboset, the apparatus according to the invention is advantageously not operated. Temperatures within the typical range of around 350° C. to over 500° C. are then present in the cavity, and the pressure is typically around 12 bar to over 30 bar. These conditions also essentially prevail in the overflow passage 14. It is therefore a considerable advantage of the invention that, compared with the prior art, no movable parts are arranged in the part subjected to high thermal and pressure loading, and no parts movable in a relative manner, such as a drive shaft for a circulation blower, have to be sealed off. Thus, the motive-fluid blower 20 can be arranged at a point subjected to low thermal and pressure loading, a factor which increases the reliability of the entire system on the one hand and reduces the outlay and costs on the other hand. Alternatively, the motive fluid may of course originate from a compressed-air system. A nonreturn element 23 and a shutoff element 24 are arranged for isolating the motive-fluid supply from the high pressures and temperatures during the operation of the gas turboset.

Figure 3:
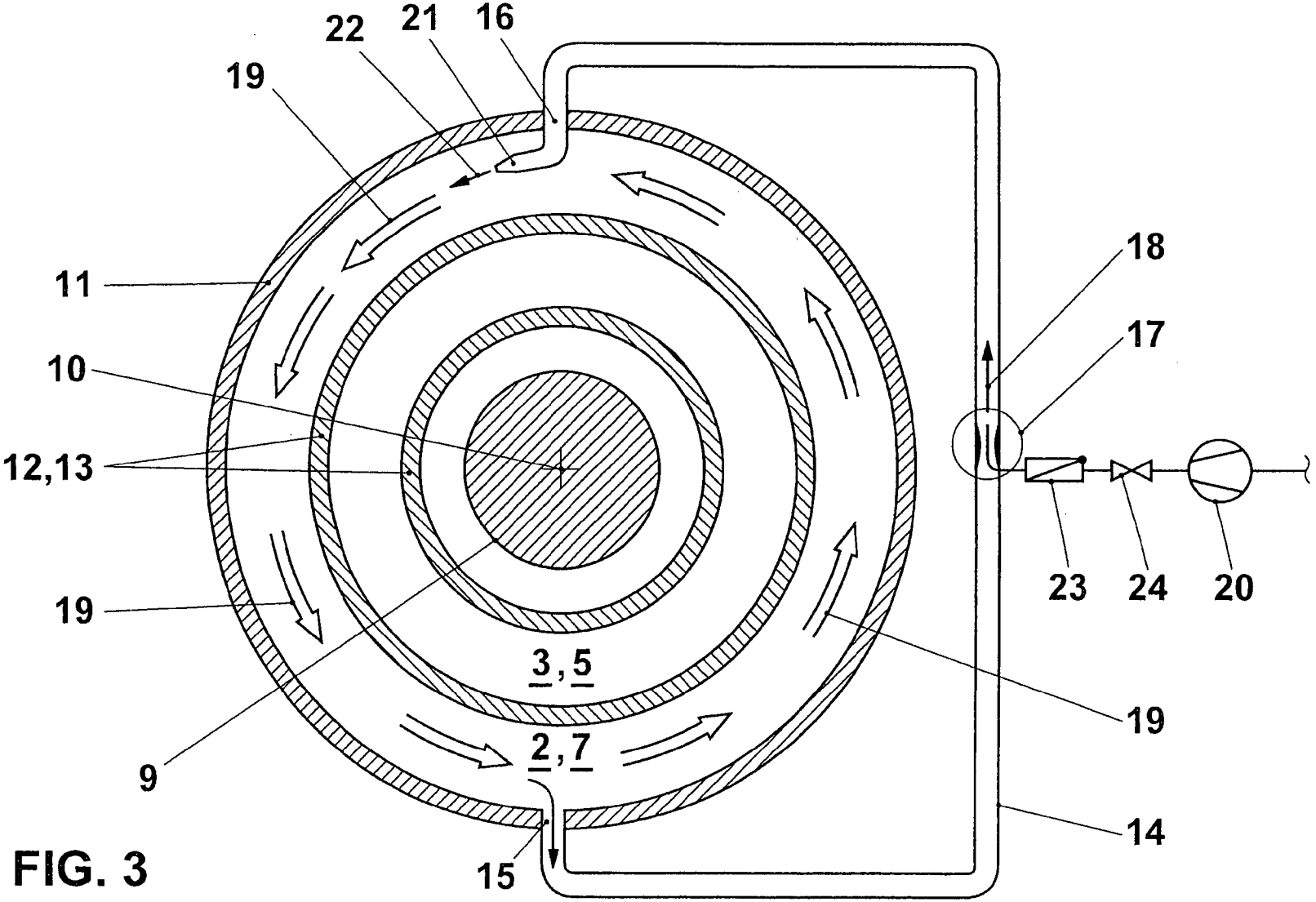
FIG. 3 shows a second example for the embodiment according to the invention of the gas turbine from FIG. 1 in cross section.

The embodiment according to FIG. 3 differs from the preceding example in that a flow guide device 21 is arranged at the downstream end of the overflow line 14 and is designed in this case as a nozzle in such a way that the discharging flow 22 likewise acts in the manner of an ejector as a motive fluid for a circulation flow 19 in the cavity 2, 7. A directional flow can thus be produced in the cavity.

Figure 4:
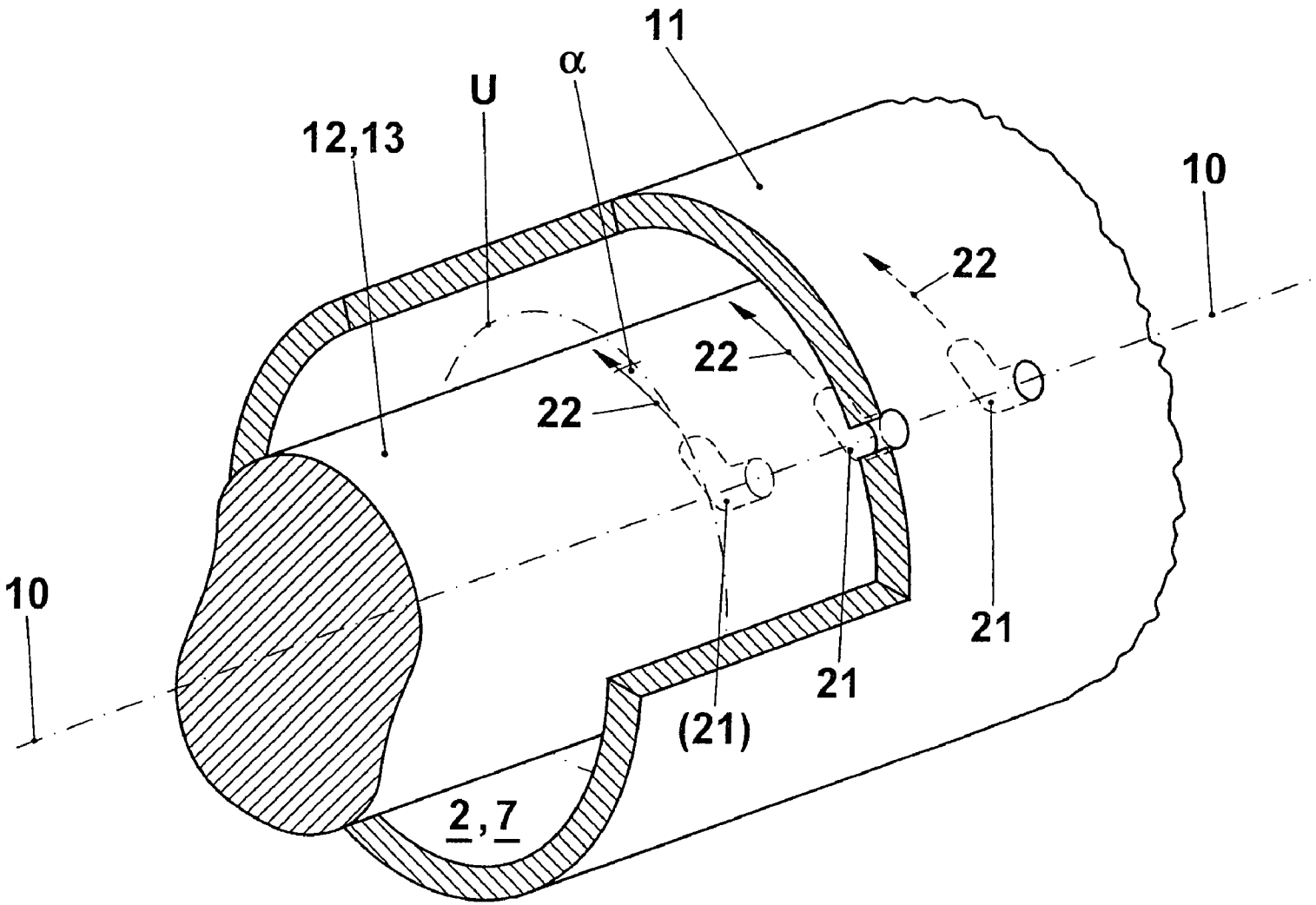
FIG. 4 shows a further preferred embodiment of the invention.

This is also particularly advantageous when there is a configuration as shown in FIG. 4. A perspective illustration of an annular cavity is shown in FIG. 4. The inner boundary 12, 13 is only shown schematically as a solid cylinder. A cavity 2, 7 is formed between this inner boundary and an outer shell 11. Distributed in the axial direction, three ejectors 21 are passed through the outer shell 11, these ejectors 21 not being visible as such in the illustration and being indicated schematically by broken lines. The ejectors are arranged in such a way that the orientation of the blow-out direction of the motive fluid 22 is inclined in the axial direction by an angle $\alpha$ relative to the circumferential direction indicated by a dot-dash line U. In order to stimulate in particular the circumferential flow primarily desired, this setting angle $\alpha$ may be restricted to values below 30°, in particular to values less than 10°. A helical flow (not shown) through the cavity consequently occurs, and this flow also helps to avoid an axial temperature gradient which possibly occurs. Furthermore, this is assisted if the downstream end and the upstream end of an overflow line are arranged in different axial positions.

The invention is in no way restricted to use in the cavities 2, 7 lying furthest on the outside. The invention may likewise be realized in a very simple manner for the combustors 3, 5 or for the space formed between the casing elements 12, 13 and the shaft 9.

The person skilled in the art will readily recognize that the use of the invention is in no way restricted to gas turbines, but rather that the invention can be used in a multiplicity of further applications. The use of the invention is of course also not restricted to a gas turbine shown in FIG. 1 and having sequential combustion, but rather it may also be used in gas turbines with only one combustor or with more than two combustors. In particular, the invention can also be realized in steam turbines.

LIST OF DESIGNATIONS

1 compressor
2 cavity, plenum
3 combustor

4 first turbine
5 combustor
6 second turbine
7 cavity
9 shaft
10 machine axis
11 outer casing, outer shell, outer wall
12 inner casing, inner wall, combustor wall
13 inner casing, inner wall, combustor wall
14 overflow line
15 bleed point, upstream end of the overflow line
16 downstream end of the overflow line
17 ejector arrangement
18 motive-fluid flow
19 compensating flow
20 motive-fluid blower
21 flow guide device, ejector
22 discharge flow
23 nonreturn element
24 shutoff element
U circumferential direction
$\alpha$ setting angle relative to the circumferential direction

What is claimed is:

1. A turbomachine comprising at least one cavity having an annular or ring-segment-shaped cross section, an overflow passage connecting two points of the cavity to one another which are situated in different circumferential positions, an ejector arranged inside the overflow passage for driving a flow through the overflow passage from an upstream end to a downstream end of the overflow passage, and a discharge guide device arranged at the downstream end of the overflow passage through which the overflow passage opens out in the cavity to impart a single circumferential flow direction on the discharging flow in the cavity, wherein the outflow direction of the discharge guide device is inclined in the axial direction at an angle of less than 30° relative to the circumferential direction of the cavity.

2. The turbomachine as claimed in claim 1, wherein the discharge guide device is a nozzle.

3. The turbomachine as claimed in claim 1, wherein the ends of the overflow passage are arranged in different axial positions of the overflow passage.

4. The turbomachine as claimed in claim 1, wherein openings for drawing off fluid from the cavity are arranged in the cavity.

5. A method of operating a turbomachine as claimed in claim 1, wherein when the turbomachine is at rest, in particular during a cooling phase following a shutdown, a fluid flows into the overflow passage through the ejector and thus drives a flow in the overflow passage.

6. The method as claimed in claim 5, wherein the mass flow through the overflow passage is proportioned in such a way that the volume of the cavity is circulated between 4 and 8 times per minute.

7. The method as claimed in claim 6, wherein the mass flow through the ejector is between 8% and 15% of the mass flow through the overflow passage.

8. The method as claimed in claim 5, wherein the mass flow through the ejector is between 8% and 15% of the mass flow through the overflow passage.

9. The method as claimed in claim 5, wherein the fluid is heated before the inflow to the ejector.

10. The turbomachine as claimed in claim 1, wherein the discharge guide device is arranged at a downstream orifice of the overflow passage.

11. The turbomachine as claimed in claim 1, wherein the outflow direction of the discharge guide device is inclined in the axial direction at an angle of less than 10° relative to the circumferential direction of the cavity.

12. A turbomachine comprising at least one cavity having an annular or ring-segment-shaped cross section, an overflow passage connecting two points of the cavity to one another which are situated in different circumferential positions, an ejector arranged inside the overflow passage for driving a flow through the overflow passage from an upstream end to a downstream end of the overflow passage, and a discharge guide device arranged at the downstream end of the overflow passage through which the overflow passage opens out in the cavity to impart a single circumferential flow direction on the discharging flow in the cavity, wherein the outflow direction of the discharge guide device is oriented essentially in the circumferential direction of the cavity.

13. The turbomachine as claimed in claim 12, wherein the discharge guide device is a nozzle.

* * * * *